US007398036B2

(12) United States Patent
Katayanagi

(10) Patent No.: US 7,398,036 B2
(45) Date of Patent: Jul. 8, 2008

(54) IMAGE FORMING APPARATUS AND IMAGE FORMING METHOD

(75) Inventor: Hidetoshi Katayanagi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 146 days.

(21) Appl. No.: 10/949,146

(22) Filed: Sep. 24, 2004

(65) Prior Publication Data

US 2005/0201779 A1 Sep. 15, 2005

(30) Foreign Application Priority Data

Mar. 12, 2004 (JP) ..... 2004-070351

(51) Int. Cl.
*G03G 15/01* (2006.01)
*G03G 13/01* (2006.01)

(52) U.S. Cl. ..... 399/223; 430/45.1

(58) Field of Classification Search ..... 399/324, 399/252, 82, 85, 223; 430/107.1, 45, 111.4
See application file for complete search history.

(56) References Cited

U.S. PATENT DOCUMENTS 5,879,848 A * 3/1999 Kurose et al. ..... 430/107.1
6,047,146 A * 4/2000 Ito et al. ..... 399/85 X
6,051,350 A * 4/2000 Inaba et al. ..... 430/45
6,274,282 B1 * 8/2001 Sugimoto et al. ..... 430/45 X
6,535,712 B2 * 3/2003 Richards ..... 399/341
2002/0012551 A1 * 1/2002 Tsutsui et al. ..... 399/252
2003/0027072 A1 2/2003 Horiuchi et al. ..... 430/137.14
2003/0113647 A1 6/2003 Matsushima et al. ... 430/137.14
2003/0198884 A1 10/2003 Yamada et al. ..... 430/110.3

FOREIGN PATENT DOCUMENTS

JP 8101553 4/1996
JP 10-177283 6/1998
JP 2002-244349 2/2001
JP 2001147554 A * 5/2001
JP 2001272815 10/2001

OTHER PUBLICATIONS

Office Action, Jul. 18, 2006, from the Japanese Patent Office.

* cited by examiner

*Primary Examiner*—David M. Gray
*Assistant Examiner*—Erika J. Villaluna
(74) *Attorney, Agent, or Firm*—Squire, Sanders & Dempsey L.L.P.

(57) ABSTRACT

An image forming apparatus including: a black developing unit accommodating black toner; and at least one color developing unit accommodating color toner. The black toner has a softening point higher than that of the at least one color toner and contains a release agent at a percentage higher than that of the at least one color toner.

2 Claims, 12 Drawing Sheets

KSP > (YSP , MSP or CSP)
KRM > (YRM , MRM or CRM)
KV > CV

KSP > (YSP , MSP or CSP)
KRM > (YRM , MRM or CRM)
KV > CV

KSP > (YSP , MSP or CSP)
KRM > (YRM , MRM or CRM)
KV > CV

YRM ≥ MRM ≥ CRM ≥ KRM
WHERE YRM > KRM
DY > DM > DC > DK

KSP > (YSP , MSP or CSP)
KRM ≥ YRM ≥ MRM ≥ CRM
WHERE KRM > CRM
DK > DY > DM > DC

KSP > (YSP , MSP or CSP)
KRM > (YRM , MRM or CRM)
KV > CV

KSP > (YSP , MSP or CSP)
KRM > (YRM , MRM or CRM)
KV > CV

TRM ≥ YRM ≥ MRM ≥ CRM ≥ KRM
WHERE TRM > KRM
DT > DY > DM > DC > DK

YRM ≥ MRM ≥ CRM ≥ WRM
WHERE YRM > WRM
DY > DM > DC > DK >DW

IMAGE FORMING APPARATUS AND IMAGE FORMING METHOD

BACKGROUND OF THE INVENTION

1. Field of the Invention

The present invention relates to an image forming apparatus which forms a color image on a recording medium such as paper, particularly to an image forming apparatus which forms a color image by an electrophotographic method, and to an image forming method of the same.

2. Description of the Related Art

In an electrophotographic color image forming apparatus, a color image is formed by superimposing a plurality of single color images, for example, a yellow image, a magenta image, a cyan image, and a black image, on a recording medium such as paper.

Among color image forming apparatuses, there is one which forms a plurality of images by repeating a plurality of steps of forming a single color image, and one which forms a plurality of images in one step. In most cases, the latter type is employed as a high-speed image forming apparatus, since this type of image forming apparatus is capable of forming a color image and a black-and-white image at substantially the same speed.

The latter type of image forming apparatuses include: one which forms a color image by forming a single color image on each of a plurality of image forming bodies, transferring each of the single color images from the image forming bodies to a recording medium, and superimposing the single color images on the recording medium to form a color image thereon; and one which forms a color image by forming a single color image on each of a plurality of image forming bodies, temporarily transferring each of the single color images to an intermediate transfer body, superimposing the single color images to form a color image thereof, and transferring the color image from the intermediate transfer body to a recording medium.

Meanwhile, in an electrophotographic image forming process, a contact heating method such as heat roller fixing is generally used. In the contact heating method, offset, in which part of toner forming an image on a recording medium is transferred from the recording medium to a fixing member, easily occurs. Moreover, a recording medium easily sticks to a fixing member. Thus, in order to prevent these phenomena, a release agent has been contained in toner.

As described above, a release agent mainly acts to prevent offset and sticking of a recording medium to a fixing member. A release agent also acts in other ways. For example, in JP-Tokukaihei-8-101553A, it is proposed that the containing percentages of release agents are differed between chromatic toner and achromatic toner in order to form a black-and-white image without unnecessary gloss and a color image with appropriate gloss by using the same image forming apparatus.

In the abovementioned latter type of color image forming apparatus, in theory, it is assumed that the amount of heat required for fixing of toner is smaller in a black-and-white image forming, since the amount of the maximum toner load of a color image on a recording medium is larger than that of a black-and-white image, and thus a black-and-white image can be formed at a speed higher than that at which a color image is formed. However, when toner disclosed in JP-Tokukaihei-8-101553A is used, the amount of the release agent which seeps out from the black toner while a recording medium passes through a fixing unit is small, and it has therefore been difficult to allow the speed of forming a black-and-white image to be higher than that of forming a color image. Moreover, when the softening point or the containing percentage of a release agent in chromatic toner is substantially the same as that in achromatic toner, gloss of a black image in a black-and-white image is increased, and thus it has been impossible to finish the black-and-white image with suppressed, desirable gloss.

In addition, disadvantages of a release agent have been known. For example, when a release agent is exposed to a temperature equal to or higher than a glass transition point or to mechanical stress such as stirring, the release agent seeps out from toner particles to the surface thereof, thus causing the toner to easily harden. Moreover, the release agent may be moved to the surface of carriers, thus deteriorating the electrostatic property of the toner.

With regard to how a color image forming apparatus is actually used, in most cases, the apparatus is used for formation of black-and-white images rather than formation of color images.

In view of such situation concerning use of color image forming apparatuses, it is desired that image forming in a black-and-white mode be carried out at a speed higher than that in a color mode.

In order to realize the above, it is necessary that the fixing efficiency in a black-and-white is higher than that in a color mode.

SUMMARY OF THE INVENTION

The present invention is made to solve the above problems.

A primary object of the present invention is to provide an improved image forming apparatus and method that are capable of forming high grade images efficiently.

Another object of the present invention is to form a color image in which a black image is formed with less gloss as compared with a color image, while the fixing efficiency of a fixing unit is improved without modifying the fixing unit and thus without an increase in cost, and the speed of forming an image in a black-and-white mode is increased.

Still another object of the present invention is to provide an image forming apparatus which prevents adverse effects of use of a release agent and forms high quality images over a long period of time, while main effects of the release agent, that is, to prevent offset and sticking of a recording medium to the fixing unit, are maintained.

To achieve at least one of the objects mentioned above, an image forming apparatus according to a first aspect of the present invention comprises: a black developing unit accommodating black toner; and at least one color developing unit accommodating color toner, wherein the black toner has a softening point higher than that of the at least one color toner and contains a release agent at a percentage higher than that of the at least one color toner.

Preferably, the image forming apparatus according to the first aspect of the invention further comprises: a controller which controls the image forming apparatus to selectively perform an image formation in a black-and-while mode with a first process speed and an image formation in a color mode with a second process speed slower than the first process speed.

Preferably, in the image forming apparatus according to the first aspect of the invention, the image formation in the black-and-white mode is carried out without using the at least one color developing unit.

Preferably, in the image forming apparatus according to the first aspect of the invention, a difference in softening point between the black toner and the at least one color toner is in a range from 4° C. to 10° C.

Preferably, in the image forming apparatus according to the first aspect of the invention, a difference in containing percentage of the release agent between the black toner and the at least one color toner is in a range from 2 wt % to 6 wt %.

An image forming method according to a second aspect of the present invention is an image forming method, comprising the steps of: performing a color image formation in a color mode with at least one color toner at a first process speed; and performing a black-and-white image formation in a black-and-white mode with black toner at a second process speed faster than the first process speed, wherein the black toner has a softening point higher than that of the at least one color toner and contains a release agent at a percentage higher than that of the at least one color toner.

Preferably, in the image forming method according to the second aspect of the invention, a difference in softening point between the black toner and the at least one color toner is in a range from 4° C. to 10° C.

Preferably, in the image forming method according to the second aspect of the invention, a difference in containing percentage of the release agent between the black toner and the at least one color toner is in a range from 2 wt % to 6 wt %.

An image forming apparatus according to a third aspect of the present invention comprises: a toner image forming section comprising: a black developing unit which forms a black image with black toner containing a release agent; a yellow developing unit which forms a yellow image with yellow toner containing a release agent; a cyan developing unit which forms a cyan image with cyan toner containing a release agent; and a magenta developing unit which forms a magenta image with magenta toner containing a release agent, wherein the toner image forming section forms on a recording medium a layered toner image comprising layers of the black image, the yellow image, the cyan image, and the magenta image so that a containing percentage of the release agent in the toner of any one of the layers is not less than that in the toner of the layer(s) positioned closer to the recording medium; and a fixing unit which fixes the layered image on the recording medium, wherein the developing units are disposed so that the containing percentage of the release agent in the toner accommodated in any one of the developing units is not less than that in the toner accommodated in developing unit(s) positioned closer to the fixing unit.

Preferably, in the image forming apparatus according to the third embodiment of the invention, the plurality of developing units further comprises: a transparent developing unit accommodating transparent toner containing a release agent at a containing percentage higher than that of any one of the black toner, the yellow toner, the cyan toner, and the magenta toner, wherein the toner image forming section forms the layered toner image on the recording medium of which a most surface layer is formed of the transparent toner.

Preferably, in the image forming according to the third aspect of the invention, the containing percentage of the release agent contained any one of the transparent toner, the black toner, the yellow toner, the cyan toner, and the magenta toner in a range from 4 wt % to 15 wt %.

Preferably, in the image forming according to the third aspect of the invention, the plurality of developing units further comprises: a white developing unit accommodating white toner containing a release agent at a containing percentage less than those of the black toner, the yellow toner, the cyan toner, and the magenta toner, wherein the toner image forming section forms the layered toner image on the recording medium of which a most bottom layer is formed of the white toner.

Preferably, in the image forming apparatus according to the third aspect of the invention, the containing percentage of the release agent contained in any one of the white toner, the black toner, the yellow toner, the cyan toner, and the magenta toner is in a range from 4 wt % to 15 wt %.

Preferably, in the image forming apparatus according to the third aspect of the invention, the white toner has a softening point lower than those of the black toner, the yellow toner, the cyan toner, and the magenta toner.

According to the image forming apparatus in accordance with the third aspect of the invention, in the toner containing the release agent, offset and sticking of a recording medium to the fixing unit upon fixing are prevented well, while deterioration in the toner and carrier as well as reduction in the toner transfer rate, all of which easily occur, can be prevented well.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DESCRIPTION OF THE PREFERRED EMBODIMENTS

Figure 1:
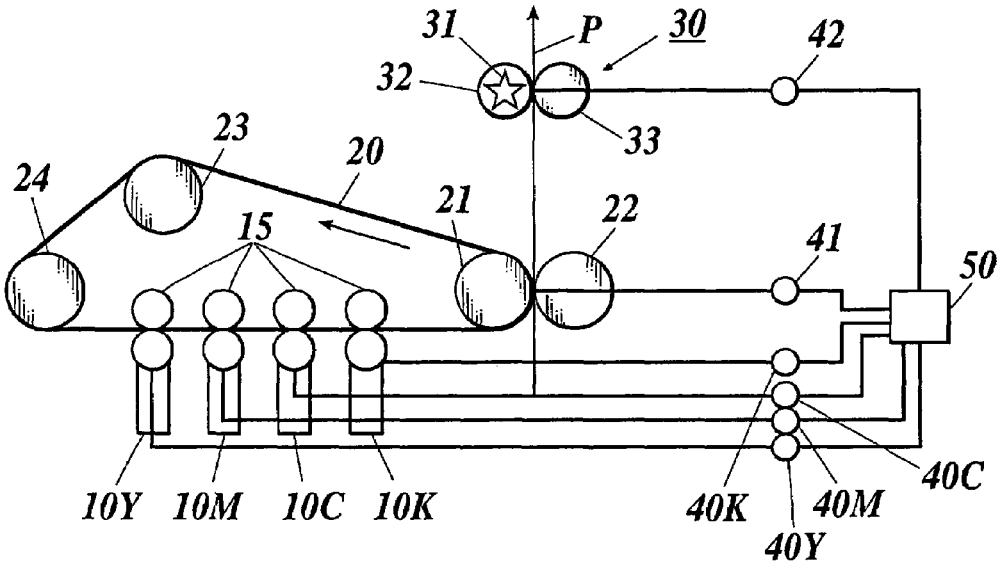
FIG. 1 is a view showing a color image forming apparatus according to a first embodiment of the present invention.

Hereinbelow, embodiments of the present invention will be described. Note that the present invention is not limited to the embodiments described below. Definitions of terms described below are given by way of explanation of the terms only, and thus the definitions of the terms of the invention are not limited thereto.

<Toner>

First, a description will be given of toner used in the following embodiments.

In the embodiments of the invention, it is preferable that a two-component developer containing toner and a carrier is used.

The toner used in the embodiments of the invention contains a binder, a coloring agent, and a release agent.

For the binder, a well-known binder is used. For example, the binder may be: a styrene resin including styrene, α-methylstyrene, divinylbenzene, and the like; an acrylic resin including methyl methacrylate, ethyl methacrylate, butyl methacrylate, 2-ethylhexyl methacrylate, methyl acrylate, ethyl acrylate, butyl acrylate, and the like; a styrene-acrylic copolymer of a styrene monomer such as styrene, α-methylstyrene and divinylbenzene and an acrylic monomer such as methyl methacrylate, ethyl methacrylate, butyl methacrylate, 2-ethylhexyl methacrylate, methyl acrylate, ethyl acrylate and butyl acrylate; a nitrogen resin containing dimethylamino methacrylate, diethylamino methacrylate, vinylpyridine, and the like; a polyester resin; an epoxy resin; a nylon resin; a urethane resin; a urea resin; and the like.

For the coloring agent, a well-known agent is used. The following may be given as examples thereof.

For a coloring agent of black toner, a carbon black such as channel black, furnace black, acetylene black, thermal black and lamp black, a magnetic material, a black pigment such as titanium black, a dye such as nigrosine may be used.

For a coloring agent of yellow toner, a dye such as C.I. solvent yellow 19, 44, 77, 79, 81, 82, 93, 98, 103, 104, 112, 162, a pigment such as C.I. pigment yellow 14, 17, 93, 94, 138, and the like may be used.

For a coloring agent of magenta toner, a dye such as C.I. solvent red 1, 49, 52, 58, 63, 111, 122, a pigment such as C.I. pigment red 5, 48:1, 53:1, 57:1, 122, 139, 144, 149, 166, 177, 178, 222, C.I. pigment orange 31, 43, and the like may be used.

For a coloring agent of cyan toner, a dye such as C.I. solvent blue 25, 36, 60, 70, 93, 95, a pigment such as C.I. pigment green 7, C.I. pigment blue 15:3, 60, and the like may be used.

Regarding a coloring agent of toner of a special color, a mixture of the above coloring agents may be used. The number average primary particle sizes of the dyes and pigments are varied according to the kinds thereof. The preferable number average particle size is approximately 10 to 200 nm.

The toner used in the following embodiments prevents offset upon contact heating fixing, and contains a release agent which prevents a recording medium from sticking to a fixing unit.

The following are examples of preferred release agents to be used.

The examples include: low-molecular-weight polyolefins such as polyethylene, polypropylene and polybutene; silicones which show a softening point when heated; fatty acid amides such as oleamide, erucamide, ricinoleamide, and stearamide; vegetable waxes such as carnauba wax, rice wax, candelilla wax, Japan wax, and jojoba oil; animal waxes such as bees wax; mineral and petroleum waxes such as montan wax, ozokerite, ceresin, paraffin wax, microcrystalline wax, and Fischer-Tropsch wax; ester waxes of higher fatty acids and higher alcohols such as stearyl stearate, behenyl behenate, and myristyl myristate; ester waxes of higher fatty acids and monovalent or polyvalent lower alcohols such as butyl stearate, glyceride monostearate, glyceride distearate, and pentaerythritol tetrabehenate; ester waxes of higher fatty acids and polyvalent alcohol polymers such as diethylene glycol monostearate, dipropylene glycol distearate, diglyceride distearate, and triglyceride tetrastearate; sorbitan higher fatty acid ester waxes such as sorbitan monostearate; cholesterol higher fatty acid ester waxes such as cholesteryl stearate; and the like. These release agents may be used alone or as a combination of two or more thereof.

An appropriate amount of these release agents to be added ranges from 0.5 to 50 wt % to the toner. Preferably, the amount ranges from 1 to 30 wt %, and more preferably, in a range from 4 to 15 wt % to the toner. When the amount of the release agent to be added is set in such a range, the release agent sufficiently seeps out to the surface of an image upon fixing, thus realizing preferable releasing capability.

It is preferable to use a release agent having a melting point ranging from 55 to 110° C., more preferably from 63 to 85° C., since such a release agent includes a preferable releasing capability. Here, the melting point of wax is the temperature of a peak showing the highest heat absorption in a differential scanning calorimetry (DSC) curve at the time of temperature rise in the DSC method. If the melting point is too high, the release agent does not seep out sufficiently, and releasing capability is thus decreased. Therefore, offset and sticking of a recording medium to the fixing unit easily occurs. If the melting point is too low, the toner is easily hardened due to the release agent, and thus the image becomes defective.

The toner further contains, as necessary, an additive such as an electrostatic charge control agent.

For the toner used in the following embodiments, it is preferable to use toner which requires less energy upon fixing and has a softening point of 95 to 140° C. in view of prevention of the toner from becoming lumpy. If the softening point is too low, it is difficult to preserve the toner under a high temperature. If the softening point is too high, the amount of heat required for fixing has to be increased.

Regarding the toner used in the following embodiments, the black toner has a softening point different from those of the other single-color toner, as described later. The softening points thereof are measured by the following measuring method, and comparison is made as to which softening point is high or low.

It is assumed that the softening point is a temperature corresponding to a midpoint between a flow start point and a flow end point obtained when a sample of 1 $cm^3$ is melted to flow by using an elevation-type flow tester "CFT-500" (produced by Shimadzu Corporation), under a condition where the die thereof has a pore diameter of 1 mm and a length of 1 mm, a load of 20 $kg/cm^2$ is applied, and a temperature rise speed is 6° C./min.

For the toner used in the following embodiments, it is preferable to use polymerized toner.

Polymerized toner can be produced as follows: fine polymerized particles are produced by polymerizing monomers through suspension polymerization or emulsion polymerization performed in a liquid in which an emulsified liquid of a necessary additive is added; and then the particles are associated by addition of an organic solvent, a coagulant, and the like. There are some ways of associating the particles. For example, monomers may be mixed into a dispersion liquid of a release agent, a coloring agent and the like which are necessary components for toner, or emulsion polymerization may be performed after toner components such as a release agent and a coloring agent are dispersed in monomers. Here, association means that a plurality of resin particles and coloring agent particles are fused together.

In other words, toner components such as a coloring agent, a release agent, an electrostatic charge control agent, and a polymerization initiator are added into polymeric monomers as necessary, and the components are dissolved or dispersed in the polymeric monomers by using a homogenizer, a sand mill, a sand grinder, an ultrasonic dispersing machine, or the like. The polymeric monomers with the components dissolved or dispersed therein are dispersed into an aqueous medium containing a dispersion stabilizer by using a homomixer, a homogenizer or the like to form oil droplets of a desired size for toner. Thereafter, the medium is transferred into a reaction device of which the stirring mechanism is a stirring wing, and then heated to proceed the polymerization reaction. After the reaction is completed, the dispersion stabilizer is removed, filtration and washing is performed, and then drying is performed. Thus, the toner used in the embodiments is prepared.

The aqueous medium in the embodiments of the invention is one containing 50 wt % or more of water.

The polymerized toner is manufactured by, for example, the methods disclosed in JP-Tokukai-2001-272815A, U.S. 2003/0198884A, U.S. 2003/0027072A, U.S. 2003/0113647A, and the like.

The toner described above is used in color image forming apparatuses of first to eighth embodiments to be described below.

<Color Image Forming Apparatus>

FIG. 1 shows a color image forming apparatus of a first embodiment of the invention.

The example shown in the drawing is a color image forming apparatus in which a color image is formed on an intermediate transfer body 20 by forming on the intermediate transfer body 20 images of respective colors through a yellow image forming section 10Y, a magenta image forming section 10M, a cyan image forming section 10C, and a black image forming section 10K. The color image formed on the intermediate transfer body 20 is transferred onto a recording medium P such as paper, and fixed thereon by a fixing unit 30.

Figure 2:
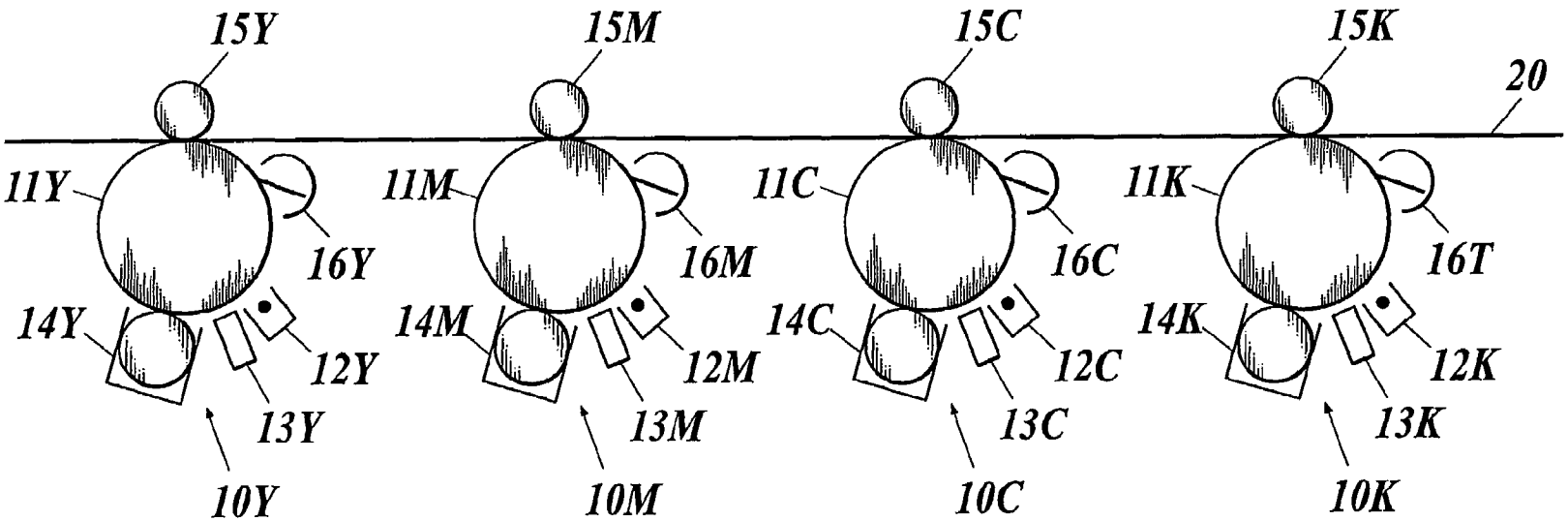
FIG. 2 is a view showing a yellow image forming section 10Y, a magenta image forming section 10M, a cyan image forming section 10C, and a black image forming section 10K.

As shown in FIG. 2, the yellow image forming section 10Y includes: a photosensitive body 11Y; a charging unit 12Y; an exposure unit 13Y; a yellow developing unit 14Y; a primary transfer roller 15Y; and a cleaning unit 16Y. The magenta image forming section 10M includes: a photosensitive body 1M; a charging unit 12M; an exposure unit 13M; a magenta developing unit 14M; a primary transfer roller 15M; and a cleaning unit 16M. The cyan image forming section includes: a photosensitive body 11C; a charging unit 12C; an exposure unit 13C; a cyan developing unit 14C; a primary transfer roller 15C; and a cleaning unit 16C. The black image forming section includes: a photosensitive body 11K; a charging unit 12K; an exposure unit 13K; a black developing unit 14K; a primary transfer roller 15K; and a cleaning unit 16K.

On the intermediate transfer body 20, there is formed a color image in which a yellow image, a magenta image, a cyan image, and a black image are superimposed. The color image formed thereon is transferred onto the recording medium P by a secondary transfer unit including a transfer roller 22 and a back-up roller 21. The intermediate transfer body 20 circulates in the direction shown by the arrow while being supported by the back-up roller 21 and supporting rollers 23 and 24.

The color image transferred onto the recording medium P is fixed thereon by the fixing unit 30. The fixing unit 30 includes a heat source 31, a heating roller 32, and a pressing roller 33, and fixes a color image by heating the color image while being in contact therewith.

In the color image forming apparatus shown in the drawing, the above-described color image forming process is executed as follows: the photosensitive bodies 11Y, 11M, 11C and 11K of the respective image forming sections 10Y, 10M, 10C and 10K are driven by motors 40Y, 40M, 40C and 40K; the intermediate transfer body 20 is driven by a motor 41; and the heating roller 32 is driven by a motor 42.

The motors 40Y, 40M, 40C, 40K, 41 and 42 are operated by control of a controller 50.

The color image forming apparatus shown in the drawing includes a color mode of forming a color image in accordance with the above-described color image forming process, and a black-and-white mode of forming a black-and-white image.

In the color mode, a color image is formed in accordance with the aforementioned process. In contrast, in the black-and-white mode, only the black image forming section 10K is operated, and the yellow image forming section 10Y, magenta image forming section 10M and cyan image forming section 10C are not operated.

In the black-and-white mode, the primary transfer rollers 15Y, 15M and 15C are withdrawn to positions away from the intermediate transfer body 20. The image forming sections 10Y, 10M and 10C may be separated from the intermediate transfer body 20.

When a softening point of the black toner accommodated in the black developing unit 14K is KSP, a softening point of the yellow toner accommodated in the yellow developing unit 14Y is YSP, a softening point of the magenta toner accommodated in the magenta developing unit 14M is MSP, and a softening point of the cyan toner accommodated in the cyan developing unit 14C is CSP, each of the toner is prepared such that the relation thereamong becomes KSP>(YSP, MSP or CSP). Such toner is prepared by selecting kinds of binder resins and adjusting the molecular weights of the binder resins. The difference between KSP and (YSP, MSP or CSP) is preferably not less than 4° C. and not more than 10° C. If the difference is too small, the black-and-white image becomes too glossy, and if the difference is too large, the difference in the glossiness between the color image and the black-and-white image becomes too prominent.

The black toner contains a release agent at a percentage higher than those of the other toner. In other words, when a containing percentage of the release agent in the black toner is KRM, that of the release agent in the yellow toner is YRM, that of the release agent in the magenta toner is MRM, and that of the release agent in the cyan toner is CRM, each of the toner is prepared such that the relation thereamong becomes KRM>(YRM, MRM or CRM). The difference between KRM and (YRM, MRM or CRM) is preferably not less than 2 wt % and not more than 6 wt %. If the difference is too small, the amount of wax seeping out upon formation of a black-and-white image does not become relatively large as compared with that seeping out upon formation of a color image, and thus there is not much difference between the amount of heat required for the wax to seep out upon formation of a black-and-white image and that required upon formation of a color image. If the difference is too large, the amount of wax seeping out from a black-and-white image is too large, and thus the image becomes too glossy.

Note that the release agent containing percentage is a containing percentage by weight.

In the black-and-white mode, the controller 50 controls the motors 40Y, 40M, 40C, 40K, 41 and 42 so that a process speed KV, that is, a linear speed between the photosensitive body 11K and the intermediate transfer body 20 and a recording medium conveying speed of the fixing unit 30, becomes higher than a process speed CV in the color mode (CV<KV).

Through such control, in the color mode, a high quality image can be formed and the image is fixed as appropriated, thereby forming a color image with sufficient gloss.

Moreover, in the black-and-white mode, since the process speed thereof is higher than that of the color mode, the number of media on which image forming is performed per unit hour is larger. Thus, image forming can be performed with high efficiency, and an eye-friendly image with suppressed gloss is formed.

A high quality image can be formed in both modes by, for example, setting the process linear speed CV in color image forming at 160 to 300 mm/sec, and the process speed KV in the black-and-white mode at 1.25 to 2.00 times higher than the CV.

A fixing temperature KT in the black-and-white mode is set equal to or higher than a fixing temperature CT in the color mode (KT≧CT). Here, the fixing unit 30 is used in both the color and black-and-white modes without changing the fixing pressure. It is most preferable that the fixing temperature KT in the black-and-white mode is equal to the fixing temperature CT in the color mode since no waiting time is required for mode switching. When the set temperature in the black-and-white mode is higher, it is preferable that the difference in fixing temperature between the black-and-white mode and the color mode is not more than 10° C., and that the heating roller of the fixing unit, which contacts with unfixed toner, is replaced by a belt of low thermal capacity as shown in FIG. 5E.

Figure 3:
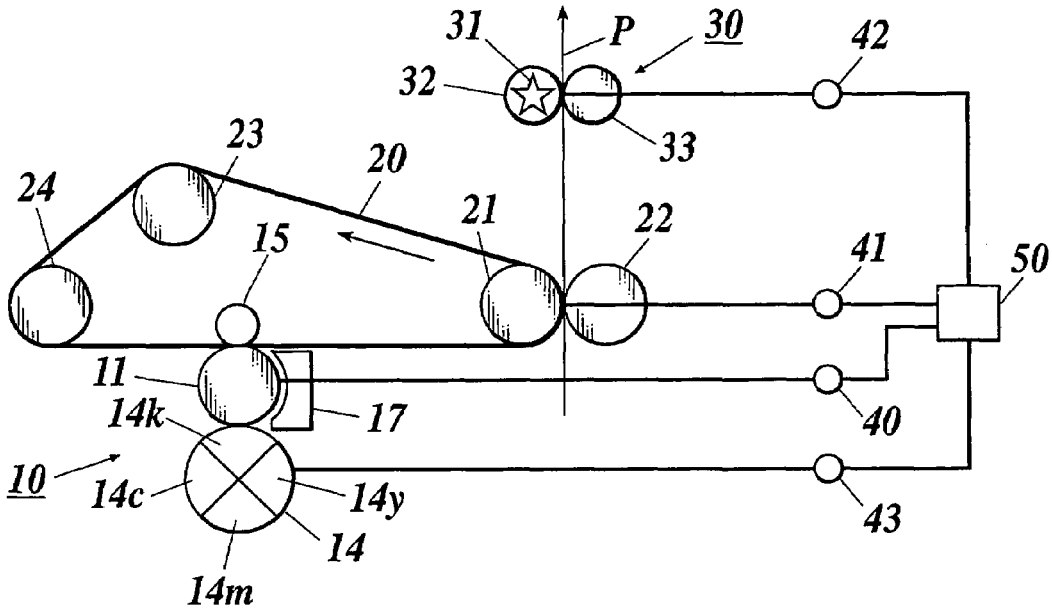
FIG. 3 is a view showing a color image forming apparatus according to a second embodiment of the invention.

FIG. 3 shows a color image forming apparatus of a second embodiment of the invention.

In FIG. 3, the color image forming apparatus includes a color image forming section 10, and the color image forming section 10 includes a photosensitive body 11 in a drum shape, a process unit 17, a developing unit 14, and a transfer unit 15. The process unit 17 includes an electrostatic charge unit, an exposure unit, and a cleaning unit.

The developing unit 14 includes a yellow developing unit 14*y*, a magenta developing unit 14*m*, a cyan developing unit 14*c*, and a black developing unit 14*k*. Yellow toner is accommodated in the yellow developing unit 14*y*, magenta toner is accommodated in the magenta developing unit 14*m*, cyan toner is accommodated in the cyan developing unit 14*c*, and black toner is accommodated in the black developing unit 14*k*.

Also in the second embodiment, toner that meets the following relations is used:

KSP>(YSP, MSP or CSP)

KRM>(YRM, MRM or CRM)

The preferred values relating to the difference between KSP and (YSP, MSP or CSP) and the difference between KRM and (YRM, MRM or CRM) are the same as those of the first embodiment. Reference numeral 43 denotes a motor which executes a developing process by driving the developing unit 14 and performs switching among the developing units 14*y*, 14*m*, 14*c* and 14*k*.

In the color mode, a yellow image is formed in a first circulation of the intermediate transfer body 20, a magenta image is formed in a second circulation, a cyan image is formed in a third circulation, and a black image is formed in a fourth circulation. The respective single color toner is superimposed to form a color image on the intermediate transfer body 20.

After the black image is formed, the secondary transfer unit is operated to transfer the color image onto a recording medium P. The color image transferred onto the recording medium P is fixed by the fixing unit 30.

In the black-and-white mode, only the black developing unit 14*k* is operated to form a black image on the intermediate transfer body 20, and the black image formed thereon is transferred onto a recording medium P by the secondary transfer unit. In the black-and-white mode, black images are sequentially formed on the intermediate transfer body 20. In other words, when image forming is performed while sequentially feeding recording media P, images are formed on the intermediate transfer body 20 at intervals which enable reduction of the spaces between the recording media P to be sequentially conveyed. Thus, an image forming process onto the recording media P is performed. In the black-and-white mode, images are formed approximately four times more efficiently than in the color mode. At this time, the surface temperature of the heating roller 32 of the fixing unit 30 is reduced more than in the case of the color mode. In the embodiments of the present invention, the wax content in the black toner is large, thus preventing offset and sticking of a recording media to the fixing unit.

The controller 50 performs control of image forming while allowing the process speed, that is, the linear speed among the photosensitive body 10, intermediate transfer body 20, and fixing unit 30 in the black-and-white mode to be higher than that in the color mode (KV>CV). Such control further improves efficiency in image forming in the black-and-white mode.

Figure 4A:
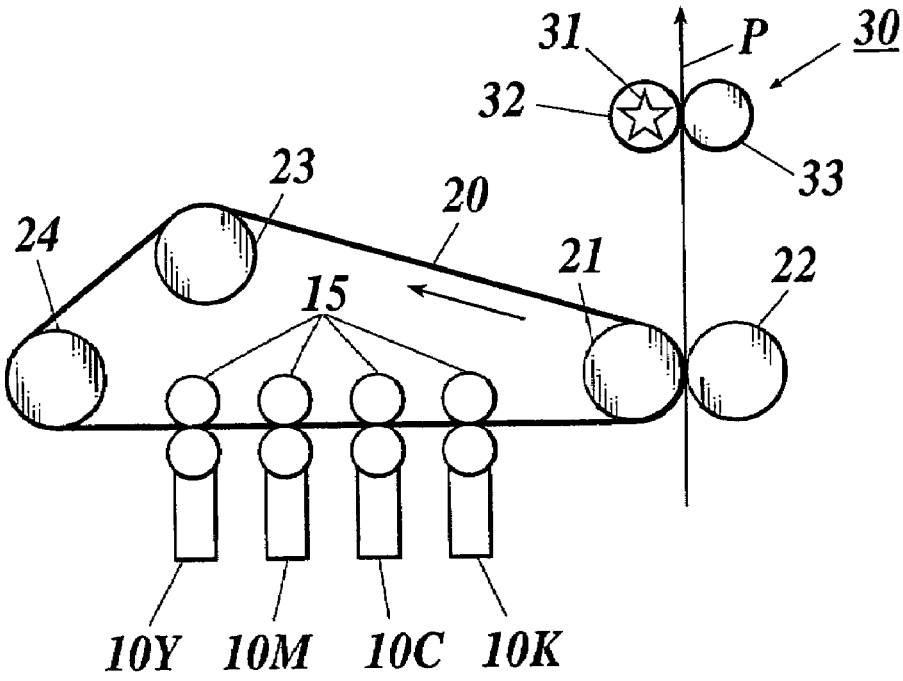
FIG. 4A is a view showing a color image forming apparatus according to a third embodiment of the invention.

FIG. 4A is a view showing a color image forming apparatus of a third embodiment of the invention.

The structure of the color image forming apparatus of the third embodiment is the same as that of the color image forming apparatus of the first embodiment shown in FIG. 1, except that there is used toner of which the containing percentages of the release agents are set as follows:

YRM≧MRM≧CRM≧KRM where YRM>KRM

The respective values of YRM, MRM, CRM and KRM are set within the range from 4 to 15 wt %.

As is clear from the drawing, the structure in FIG. 4A satisfies the following condition with regard to the arrangement of the yellow developing unit 14Y, magenta developing unit 14M, cyan developing unit 14C, and black developing unit 14K:

DY>DM>DC>DK where DY is a distance between the yellow developing unit 14Y and the heat source 31, DM is a distance between the magenta developing unit 14M and the heat source 31, DC is a distance between the cyan developing unit 14C and the heat source 31, and DK is a distance between the black developing unit 14K and the heat source 31.

Figure 4B:
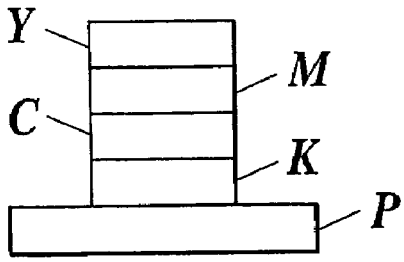
FIG. 4B is a view showing a color image created by the color image forming apparatus according to the third embodiment of the invention.

A color image to be formed on a recording medium P by the color image forming apparatus is formed on the recording medium P such that a black image K, a cyan image C, a magenta image M, and a yellow image Y are arranged from bottom to top in this order, as shown in FIG. 4B.

With regard to such a color image, in the fixing unit 30, a layer of the yellow image Y is brought into contact with the heating roller 32 which is a heating member, and a layer of the magenta image M, a layer of cyan image C, and a layer of black image K are arranged in this order as viewed from the heating roller 32.

A color image is not limited to such a four-layered image. A color image may include portions comprising layered images of one to three single color images, for example, layers of a yellow image, a red image, and a black image. According to the present embodiment, offset and sticking of a recording medium to the fixing unit can be prevented well regardless of the differences among the structures of layered portions of a color image.

In other words, the most surface layer on a recording medium will be the yellow image Y in a four-layered image, the yellow image Y or magenta image M in a three-layered image, the yellow image Y, magenta image M, or cyan image C in a two-layered image, and the yellow image Y, magenta image M, cyan image C, or black image K in a single-layered image. As the total toner amount increases, the more likely offset or sticking of a recording medium to the fixing unit occurs. When the amounts of the release agents in the respective toner are set as described above, the toner likely to form the most surface layer on a recording medium contains more amount of release agent than that forming the other layer(s). Thus, occurrence of offset and sticking of a recording medium to the fixing unit upon fixing can be efficiently prevented under any image conditions.

Moreover, since the yellow developing unit 14Y, which accommodates therein the yellow toner containing more amount of release agent than the other toner, is placed at a position farthest from the heat source 31 of the fixing unit 30, the yellow toner is placed at a position most unlikely to be affected by heat from the fixing unit 30. Thus, a drawback that the toner containing more amount of release agent is more likely to be deteriorated by heat can be compensated, thereby preventing deterioration in the developers. As shown in FIGS. 4A and 4B, the developing unit accommodating toner containing more amount of release agent than the other developing unit(s) is placed farther from the heat source 31. Accordingly, deterioration in the developers of the respective color toner can be prevented.

There are various kinds of fixing units 30, and thus the number of and the position of the heat source(s) are different according to the kinds of the fixing units 30. Representative examples are shown in FIGS. 5A, 5B, 5C, 5D and 5E.

Figure 5A:
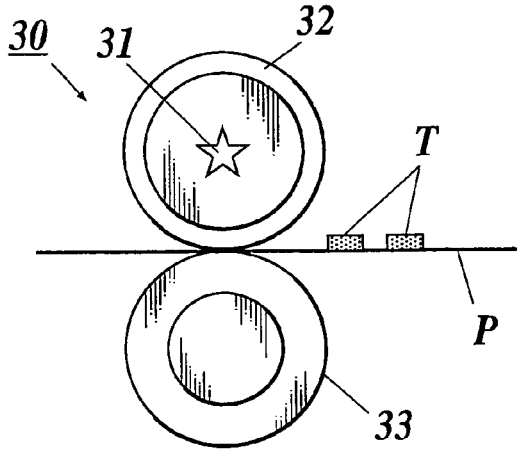
FIGS. 5A through 5E are views showing variations of fixing units 30.

FIG. 5A is an example showing a most common fixing unit 30. A recording medium P is introduced between the heating roller 32 and the pressing roller 33 for fixing. The heat source 31 is provided inside the heating roller 32, and the heating roller 32 heats and melts toner T while being in contact with the toner T, thus performing fixing of the toner T.

Figure 5B:
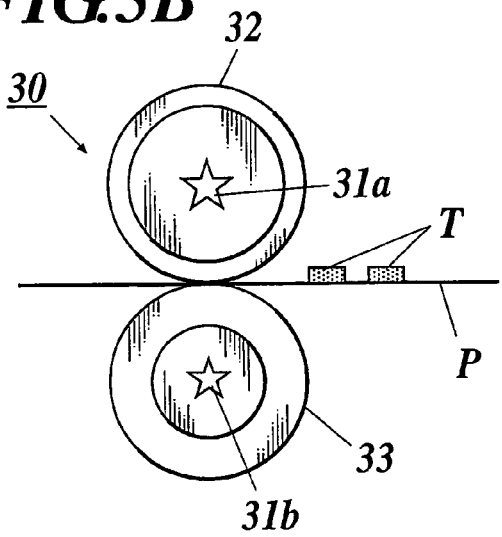

In an example shown in FIG. 5B, a heat source 31*a* is provided inside the heating roller 32, and a heat source 31*b* is provided inside the pressing roller 33. Both of the heat sources heat a recording medium P and toner T, thus performing fixing of the toner T.

Figure 5C:
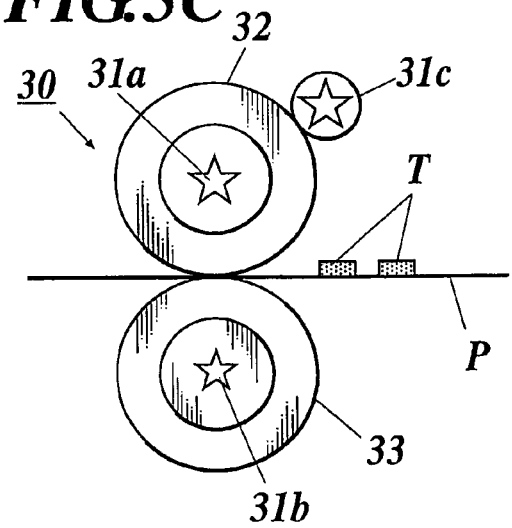

In an example shown in FIG. 5C, a heat source 31*c* is further added to the fixing unit 30 shown in FIG. 5B. The surface of the heating roller 32 is heated by the heat source 31*c*.

Figure 5D:
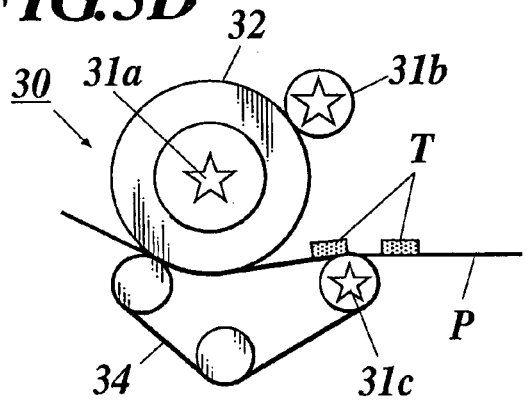
Figure 5E:
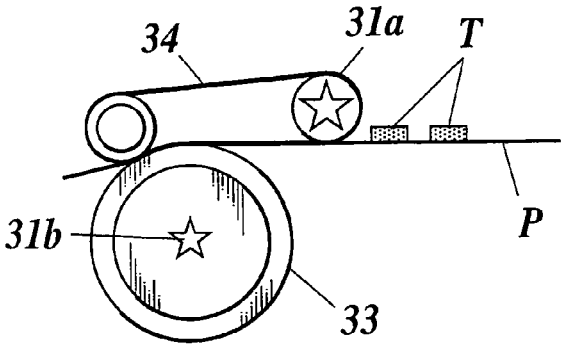

In an example shown in FIG. 5D, the heating roller 32 and a belt 34 are used. Heat sources 31*a* and 31*b* are provided inside and outside the heating roller 32, respectively, and a heat source 31*c* is provided on an inner side of the belt 34.

In an example shown in FIG. 5E, a heating belt 34 is provided. Heat sources 31*a* and 31*b* are provided on an inner side of the heating belt 34 and inside the pressing roller 33, respectively.

The distances between the developing units of the image forming sections and the heat source(s) of the respective kinds of fixing units as shown in FIGS. 5A, 5B, 5C, 5D and 5E can be defined as follows.

In general, one of a plurality of heat sources is used as a main heat source. The distances between the heat source and the respective image forming sections are defined as distances between the main heat source that generates largest amount of heat and the developing units of the respective image forming sections. By setting the distances DY, DM, DC and DK as described above, deterioration in the developers can be prevented.

In most cases, the main heat source is a heat source placed on a toner image carrying face side of a recording medium P having a toner image T.

Figure 6A:
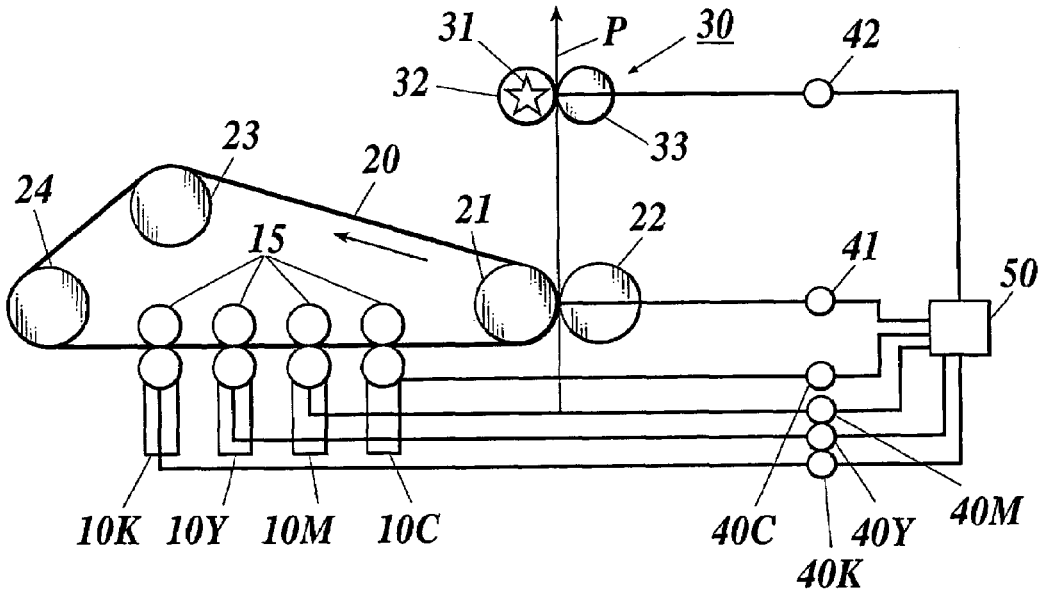
FIG. 6A is a view showing a color image forming apparatus according to a fourth embodiment of the invention.

FIG. 6A is a view showing a color image forming apparatus of a fourth embodiment of the invention.

In the fourth embodiment, a black image forming section 10K, a yellow image forming section 10Y, a magenta image forming section 10M, and a cyan image forming section 10C are placed in this order in the moving direction of a intermediate transfer body 20, and form respective single color images.

Toner having relations as described below with regard to the softening points and to the release agents is used:

$$KSP>(YSP, MSP \text{ or } CSP)$$

$$KRM \geqq YRM \geqq MRM \geqq CRM \text{ where } KRM>CRM$$

As is clear from the drawing, the relation among the distances between the respective image forming sections 10K, 10Y, 10M and 10C and a heating unit 30 is DK>DY>DM>DC.

Figure 6B:
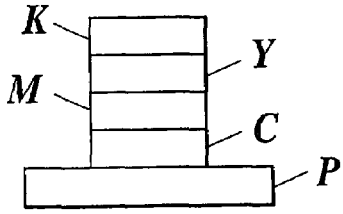
FIG. 6B is a view showing a color image created by the color image forming apparatus according to the fourth embodiment of the invention.

A color image to be formed on a recording medium P by this color image forming apparatus is formed on the recording medium P such that a cyan image C, a magenta image M, a yellow image Y, and a black image K are arranged from bottom to top in this order, as shown in FIG. 6B.

The preferred values relating to the difference between KSP and (YSP, MSP or CSP) and the difference between KRM and (YRM, MRM or CRM) are the same as those of the first embodiment.

A controller 50 executes image forming in the black-and-white mode and the color mode at process velocities satisfying the following relation:

$$CV>KV$$

That is, the fourth embodiment shown in FIG. 6A is an example that improves productivity in the black-and-white mode and prevents deterioration in the developers.

Figure 7:
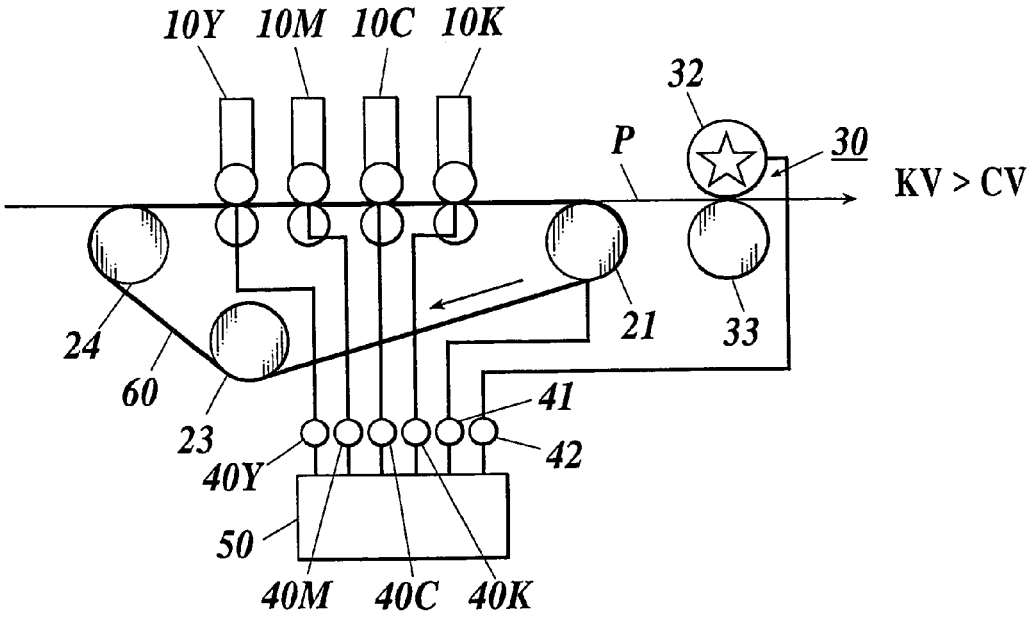
FIG. 7 is a view showing a color image forming apparatus according to a fifth embodiment of the invention.

FIG. 7 shows a color image forming apparatus of a fifth embodiment of the invention.

A recording medium P is conveyed horizontally by a conveyor belt 60. A yellow image, a magenta image, a cyan image, and a black image are formed and superimposed on the recording medium P by a yellow image forming section 10Y, a magenta image forming section 10M, a cyan image forming section 10C, and a black image forming section 10K, respectively, thus forming a color image on the recording medium P. The color image thus formed is fixed thereon by a fixing unit 30.

Also in the fifth embodiment, toner that meets the following relations with regard to the softening points and the containing percentages of the release agents is used. A controller 50 executes image forming such that a relation between a process speed KV and a process speed CV in the black-and-white mode and the color mode, respectively, is KV>CV.

KSP>(YSP, MSP or CSP)

KRM>(YRM, MRM or CRM)

The preferred values relating to the difference between KSP and (YSP, MSP or CSP) and the difference between KRM and (YRM, MRM or CRM) are the same as those of the first embodiment.

Figure 8:
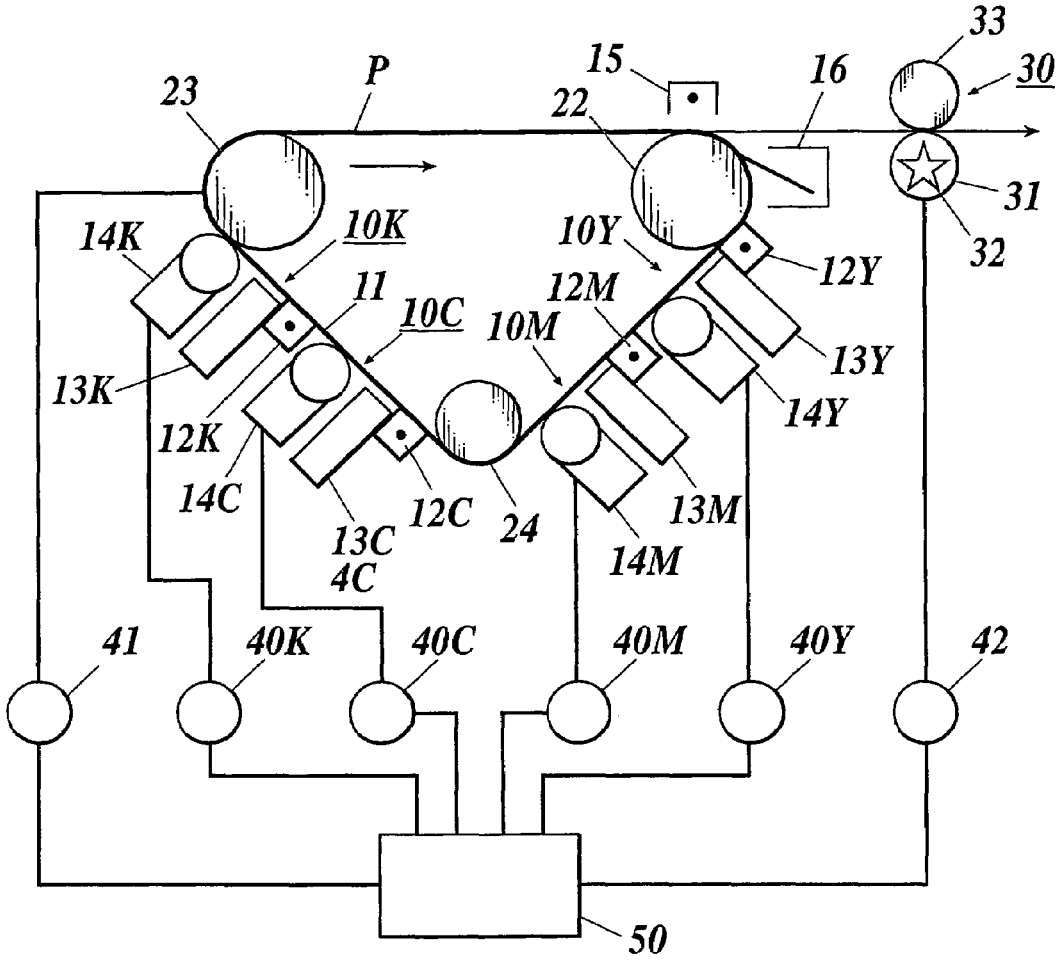
FIG. 8 is a view showing a color image forming apparatus according to a sixth embodiment of the invention.

FIG. 8 shows a color image forming apparatus of a sixth embodiment of the invention.

In the sixth embodiment, a belt photosensitive body 11 is used as an image forming body.

In positions opposed to the belt photosensitive body 11, there are provided: a yellow image forming section 10Y including an electrostatic charge unit 12Y, an exposure unit 13Y, and a yellow developing unit 14Y; a magenta image forming section 10M including an electrostatic charge unit 12M, an exposure unit 13M, and a magenta developing unit 14M; a cyan image forming section 10C including an electrostatic charge unit 12C, an exposure unit 13C, and a cyan developing unit 14C; and a black image forming section 10K including an electrostatic charge unit 12K, an exposure unit 13K, and a black developing unit 14K.

A yellow image, a magenta image, a cyan image, and a black image are formed and superimposed on the photosensitive body 11 in accordance with the circulation movement shown by the arrow, thus forming a color image.

The color image thus formed is transferred onto a recording medium P by a transfer unit 15, and fixed thereon by a fixing unit 30.

Also in the sixth embodiment, toner that meets the following relations with regard to the softening points and the containing percentages of the release agents is used. A controller 50 executes image forming such that a relation between a process speed KV and a process speed CV in the black-and-white mode and the color mode, respectively, is KV>CV.

KSP>(YSP, MSP or CSP)

KRM>(YRM, MRM or CRM)

The preferred values relating to the difference between KSP and (YSP, MSP or CSP) and the difference between KRM and (YRM, MRM or CRM) are the same as those of the first embodiment.

That is, the sixth embodiment shown in FIG. 8 is an example that improves productivity in the black-and-white mode and prevents deterioration of the developers.

Figure 9A:
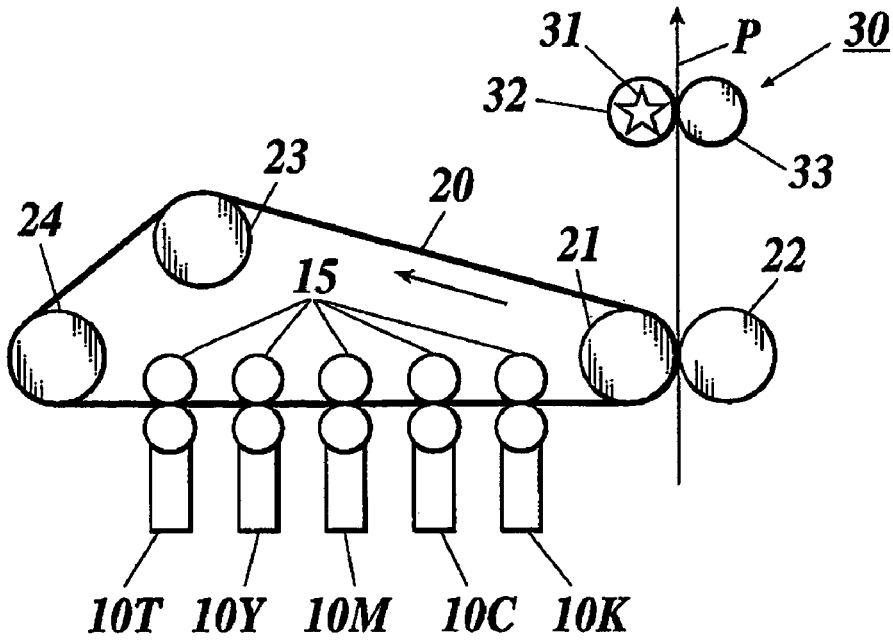
FIG. 9A is a view showing a color image forming apparatus according to a seventh embodiment of the invention.

FIG. 9A shows a color image forming apparatus of a seventh embodiment of the invention.

The color image forming apparatus of the seventh embodiment forms a glossy image by using transparent toner.

As shown in the drawing, along the direction shown by the arrow in which an intermediate transfer body 20 moves, a transparent toner layer forming section 10T which forms a transparent toner layer, a yellow image forming section 10Y, a magenta image forming section 10M, a cyan image forming section 10C and a black image forming section 10K are placed in this order.

Figure 10:
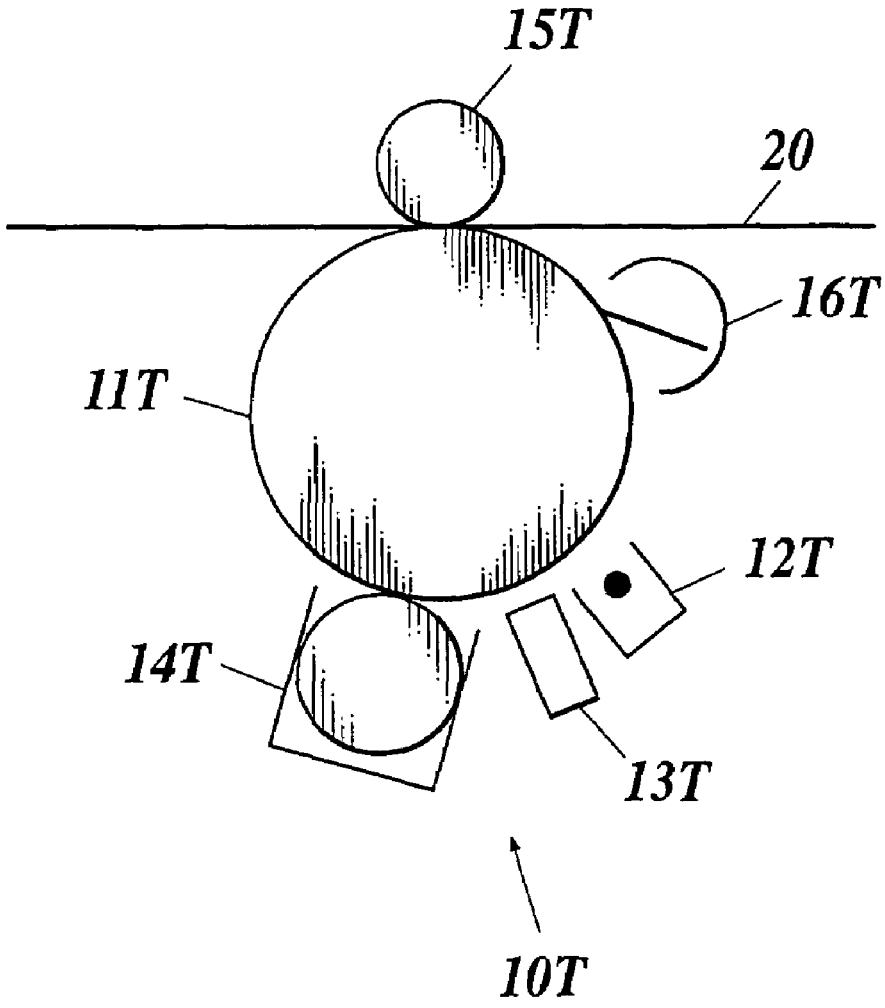
FIG. 10 is a view showing a transparent toner layer forming section 10T.

The structure of the transparent toner layer forming section 10T is as shown in FIG. 10. The transparent layer forming section 10T includes a photosensitive body 11T, an electrostatic charge unit 12T, an exposure unit 13T, a transparent developing unit 14T, a primary transfer roller 15T, and a cleaning unit 16T.

The transparent toner layer is a layer to form a glossy image by making an ordinary image glossy, especially to improve the quality of a color image. There are some modes of forming the transparent toner layer. For example, as have been well known, the transparent toner layer may be formed on the entire surface of a recording medium P, and may be formed on an image portion thereof. When it is preferable that the texture of white part of a recording medium P such as paper is unchanged, the transparent toner layer is formed only on an image forming portion.

Figure 9B:
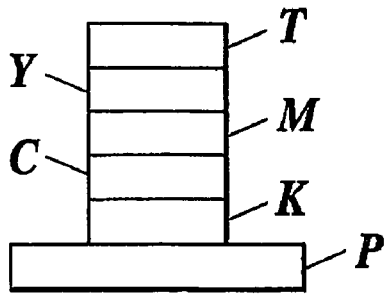
FIG. 9B is a view showing a color image created by the color image forming apparatus according to the seventh embodiment of the invention.

As shown in FIG. 9B, when a transparent toner layer T is formed on an image portion, the exposure unit 13T performs exposure based on image data obtained by implementing the OR operation on Y, M, C and K image data. Thus, the transparent toner layer T covering all of the yellow image Y, magenta image M, cyan image C, and black image K is formed.

For the toner containing the transparent toner, toner that meets the following condition is used. The image forming sections 10T, 10Y, 10M, 10C and 10K are placed so as to satisfy the following condition.

TRM≧YRM≧MRM≧CRM≧KRM where
TRM>KRM

DT>DY>DM>DC>DK

Here, TRM is a percentage of release agent by weight contained in the transparent toner, and DT is a distance between the transparent developing unit 14T of the transparent toner layer forming section 10T and a heat source 31.

The respective values of TRM, YRM, MRM, CRM and KRM are set within the range from 4 to 15 wt %.

By forming a color image using toner satisfying the above condition, a gloss-enriched, high quality color image can be formed owing to the transparent toner, and occurrence of offset and sticking of a recording medium to the fixing unit upon fixing can be efficiently prevented. Moreover, since the developing unit which accommodates therein the transparent toner containing more amount of release agent than the other toner is placed at a position farthest from the heat source 31 of the fixing unit 30, the transparent toner is placed at a position most unlikely to be affected by heat from the fixing unit 30. Thus, a drawback that the toner containing more amount of release agent is more likely to be deteriorated by heat can be compensated, thereby preventing deterioration in the developers. As shown in FIGS. 9A and 9B, the developing unit accommodating toner containing more amount of release agent than the other developing unit(s) is placed farther from the heat source 31 than the other developing unit(s). Accordingly, deterioration in the developers of the respective color toner can be prevented.

Figure 11A:
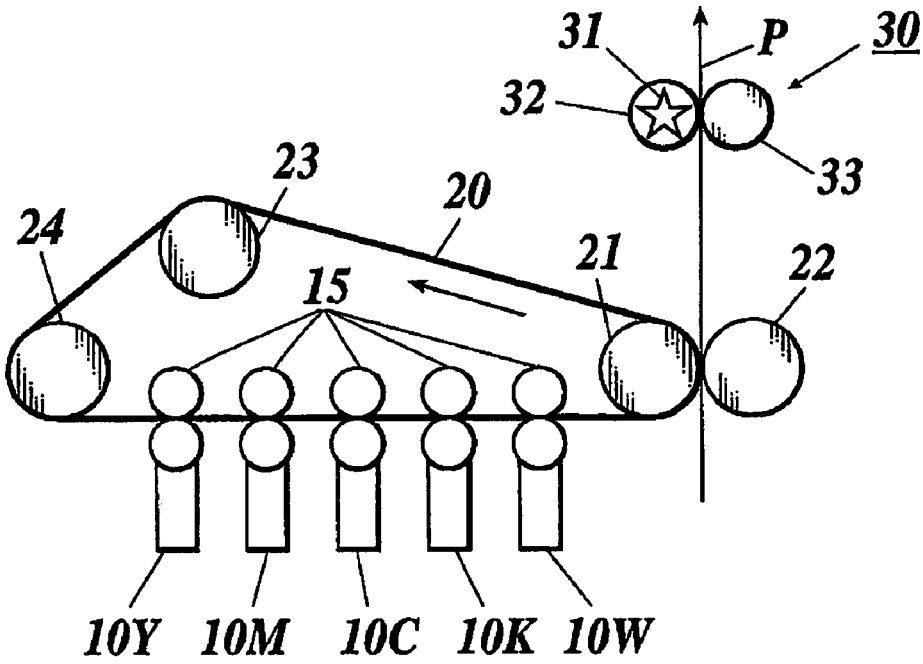
FIG. 11A is a view showing a color image forming apparatus according to an eighth embodiment of the invention.

FIG. 11A shows a color image forming apparatus of an eighth embodiment of the invention.

The color image forming apparatus of the eighth embodiment forms a high quality image by using white toner without depending on the quality of a recording medium such as brightness.

As shown in the drawing, along the direction shown by the arrow in which an intermediate transfer body 20 moves, a yellow image forming section 10Y, a magenta image forming section 10M, a cyan image forming section 10C, a black image forming section 10K, and a white toner layer forming section 10W which forms a white toner layer are placed in this order.

Figure 12:
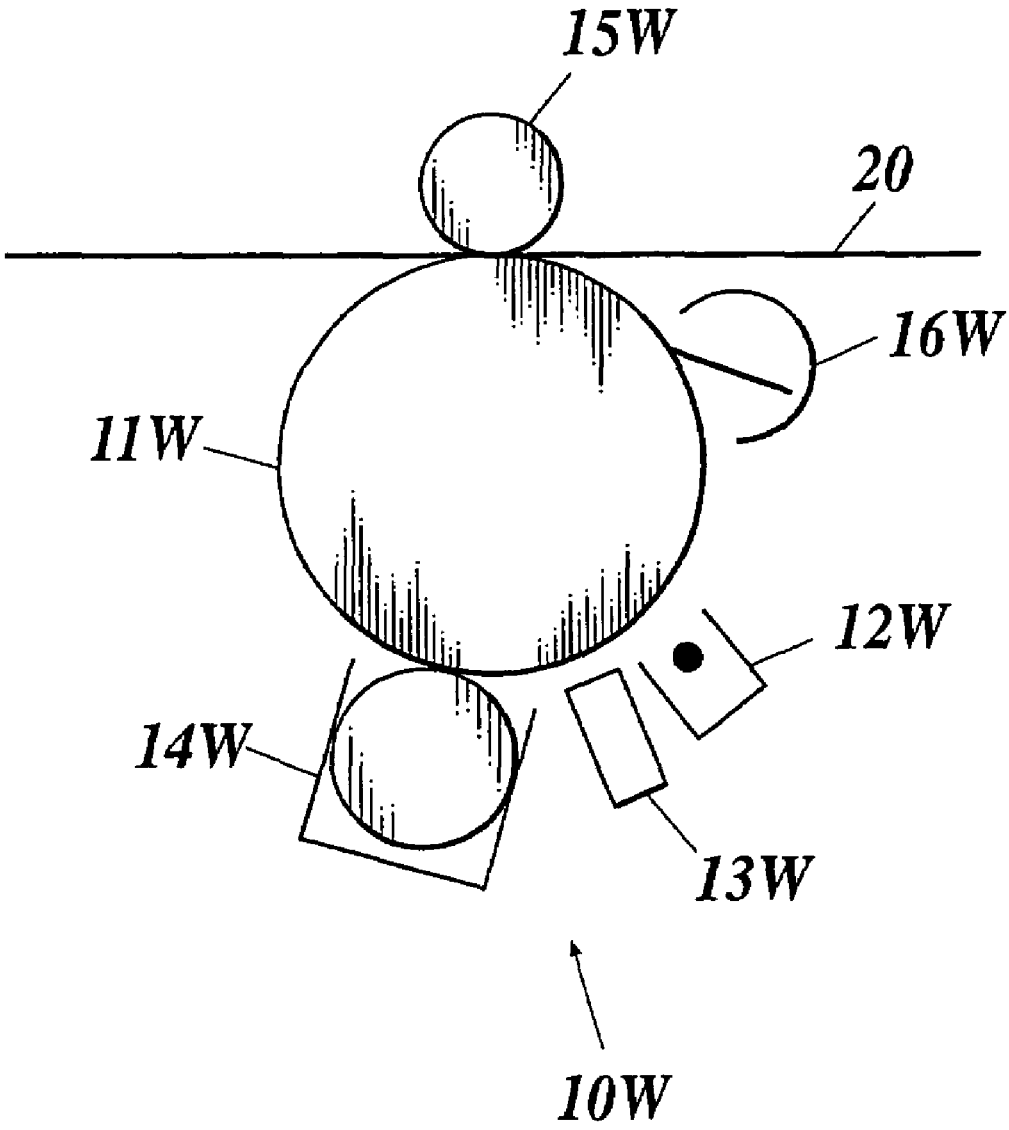
FIG. 12 is a view showing a white toner layer forming section 10W.

There are some kinds of white toner layer forming section 10W. For example, as have been well known, the white toner layer forming section 10W may form a white toner layer on the entire surface of a recording medium P, and may form a white toner layer on an image portion thereof. When it is preferable that the texture of white part of a recording medium P such as paper is unchanged, the white toner layer is formed only on an image portion. The structure of the white toner layer forming section 10W is as shown in FIG. 12. The white layer forming section 10T includes a photosensitive body 11W, an electrostatic charge unit 12W, an exposure unit 13W, a white developing unit 14W, a primary transfer roller 15W, and a cleaning unit 16W.

Figure 11B:
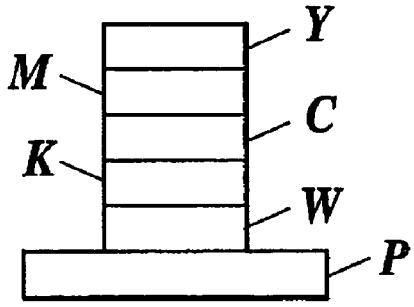
FIG. 11B is a view showing a color image created by the color image forming apparatus according to the eighth embodiment of the invention.

As shown in FIG. 11B, when a white toner layer W is formed on an image portion, the exposure unit 13W performs exposure based on image data obtained by implementing the OR operation on Y, M, C and K image data. Thus, the white toner layer W is formed under all of the yellow image Y, magenta image M, cyan image C, and black image K is formed.

For the toner containing the white toner, toner that meets the following condition is used. The image forming sections 10Y, 10M, 10C and 10K and the white toner layer forming section 10W are placed so as to satisfy the following condition.

$$YRM \geqq MRM \geqq CRM \geqq KRM \geqq WRM \text{ where } YRM > WRM$$

$$DY > DM > DC > DK > DW$$

Here, WRM is a percentage of release agent by weight contained in the white toner, and DW is a distance between the white developing unit 14W of the white toner layer forming section 10W and a heat source 31.

The respective values of YRM, MRM, CRM, KRM and WRM are set within the range from 4 to 15 wt %.

By forming a color image using toner satisfying the above condition, a high quality color image can be formed while securing fixing property thereof without depending on the quality of a recording medium such as brightness. The white toner layer is always the most bottom layer of an image. In the eighth embodiment, the amount of wax contained in the white toner is suppressed, thus preventing the wax that has seeped out of the toner from inhibiting adhesion between a toner binder resin and a recording medium. Further, by setting the amounts of the release agents in the respective toner as described above, the toner layer likely to be the most surface layer on a recording medium is allowed to contain more amount of release agent than the other toner layer(s). Thus, occurrence of offset and sticking of a recording medium to the fixing unit upon fixing can be efficiently prevented under any image conditions. Furthermore, since the developing unit which accommodates therein the yellow toner containing more amount of release agent than the other toner is placed at a position farthest from the heat source 31 of the fixing unit 30, the yellow toner is placed at a position most unlikely to be affected by heat from the fixing unit 30. Thus, a drawback that the toner containing more amount of release agent is more likely to be deteriorated by heat can be compensated, thereby preventing deterioration in the developers. As shown in FIG. 10, the developing unit accommodating toner containing more amount of release agent than the other developing unit (s) is placed farther from the heat source 31 than the other developing unit(s). Accordingly, deterioration in the developers of the respective color toner can be prevented.

For the white toner, it is preferable to use toner of which softening point WSP satisfies WSP<(YSP, MSP, CSP, KSP). Thus, adhesion of an image to a recording medium is enforced, and the image is fixed well onto the recording medium.

The entire disclosure of Japanese Patent Application No. Tokugan 2004-070351 filed on Mar. 12, 2004 including specification, claims, drawings and summary are incorporated herein by reference in its entirety.

What is claimed is:

1. An image forming apparatus comprising:

a toner image forming section comprising: a black developing unit which forms a black image with black toner containing a wax as a release agent; a yellow developing unit which forms a yellow image with yellow toner containing a wax as a release agent; a cyan developing unit which forms a cyan image with cyan toner containing a wax as a release agent; and a magenta developing unit which forms a magenta image with magenta toner containing a wax as a release agent, wherein the toner image forming section forms on a recording medium a layered toner image comprising layers of the black image, the yellow image, the cyan image, and the magenta image so that a containing percentage of the wax as the release agent in the toner of any one of the layers is not less than that in the toner of the layer(s) positioned closer to the recording medium; and a fixing unit which fixes the layered image on the recording medium, wherein the developing units are rigidly disposed so that the containing percentage of the wax as the release agent in the toner accommodated in any one of the developing units is not less than that in the toner accommodated in developing unit(s) positioned closer to the fixing unit.

2. The image forming apparatus of claim 1, wherein the wax as the release agent has a melting point within a range from 55 to 110° C.

* * * * *